United States Patent [19]

Jeschke

[11] Patent Number: 4,873,806

[45] Date of Patent: Oct. 17, 1989

[54] FLEXIBLE SPLICE FOR METAL FRAME MEMBERS IN A CURTAIN WALL

[75] Inventor: Fred G. Jeschke, Whitmore Lake, Mich.

[73] Assignee: American Glass and Metal Corporation, Plymouth, Mich.

[21] Appl. No.: 270,075

[22] Filed: Nov. 14, 1988

[51] Int. Cl.[4] ..... E04H 1/00; E04C 3/30

[52] U.S. Cl. ..... 52/235; 52/726

[58] Field of Search ..... 52/235, 403, 781, 397, 52/726

[56] References Cited

U.S. PATENT DOCUMENTS 3,333,429 8/1967 Dougherty ..... 52/726

3,357,145 12/1967 Grossman ..... 52/235

4,081,941 4/1978 Van Ausdall ..... 52/726

4,644,717 2/1987 Biebuyck ..... 52/403

*Primary Examiner*—Carl D. Friedman

*Assistant Examiner*—Michele A. Van Patten

*Attorney, Agent, or Firm*—Harness, Dickey & Pierce

[57] ABSTRACT

A silicone slab for use in a building curtain wall to seal the joints between adjacent support members in the curtain wall. The curtain members define a U-shaped channel for support of the curtain wall material. Adjacent ends of the support members are sealed by placing a silicone slab in the joint bridging the two support members. The silicone slab is retained in place by a silicone sealant.

4 Claims, 3 Drawing Sheets

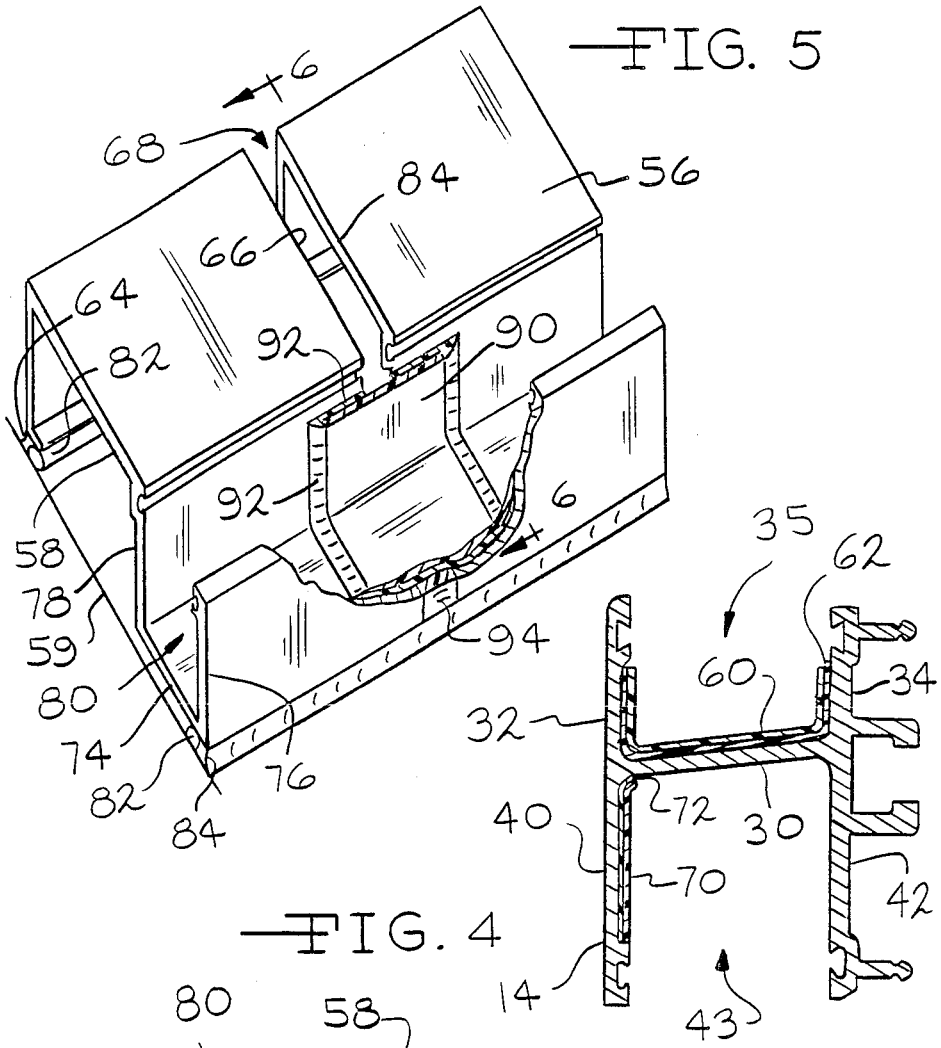
FIG. 5
FIG. 4
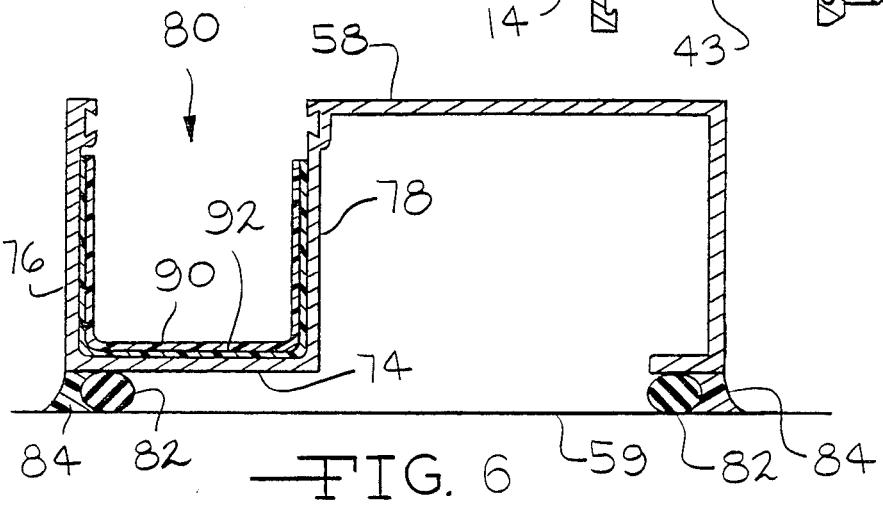
FIG. 6

FLEXIBLE SPLICE FOR METAL FRAME MEMBERS IN A CURTAIN WALL

BACKGROUND AND SUMMARY OF THE INVENTION

This invention pertains to a curtain wall for use in a building exterior and more particularly to a silicone slab splice joint for preventing leakage between adjacent support members in the curtain wall.

Curtain walls are typically constructed of an aluminum frame support members which provide generally U-shaped channels for supporting a panel or sheet material which serves as the building exterior. The curtain wall panel material is often panes of glass but can be other exterior building materials such as aluminum, granite, slate, or concrete panels or the like. For simplicity in explanation only, the discription contained herein will pertain to a glass curtain wall.

The curtain walls are constructed of a plurality of horizontal aluminum support members which define an upwardly directed U-shaped channel, a downwardly directly U-shaped channel or both upwardly and downwardly U-shaped channels. These horizontal support members are held in place by vertical mullions which are interiorly of the horizontal support members.

Glass panels are supported in an upwardly directed U-shaped channel at the lower edge of the glass panel and in a downwardly directed U-shaped channel at the upper edge of the glass panel. The vertical joints between adjacent glass panels are sealed with a silicone sealant to prevent leakage between glass panels. Because the horizontal aluminum support members will expand and contract with temperature fluctuations, the joints between the adjacent horizontal members must allow for this expansion and contraction. The expansion and contraction is accomodated by providing a space between adjacent ends of the support members. Typically, the space between adjacent support members has been sealed with a conventional caulking material. Difficulties, however, have arisen in preventing leaks in that the effectiveness of the caulking to prevent leaks is relatively short lived. After a short number of expansion and contraction cycles and weathering, the caulking compound will crack and split to the point that it is no longer capable of preventing leakage between the support members.

Accordingly it is an object of this invention to provide an improved joint between adjacent horizontal support members in a curtain wall.

This is accomplished by molding a flat slab of silicone which is then placed in the support member U-shaped channel bridging the space between adjacent ends of the support member. The silicone slab is retained in place in the support member by means of a silicone sealant which is formed of essentially the same material as the slab. The slab forms a bridge between the adjacent support members thus preventing leakage therebetween. The superior quantities of the silicone material allow for numerous cycles of expansion and contaction of the joint without degrading the silicon material to the point which would allow leakage through the joint.

Further objects, features and advantages of the invention will become apparent from a consideration of the following description and the appended claims when taken in conjunction with the accompanying drawings.

BRIEF DESCRIPTION OF THE DRAWINGS

FIG. 4 is a sectional view as seen from substantially the line 4—4 of FIG. 3;

FIG. 5 is a perspective view showing a joint between adjacent holding members showing, etc (same FIG. 3); and FIG. 6 is a sectional view as seen from substantially the line 6—6 of FIG. 5.

DETAILED DESCRIPTION OF THE INVENTION

Figure 1:
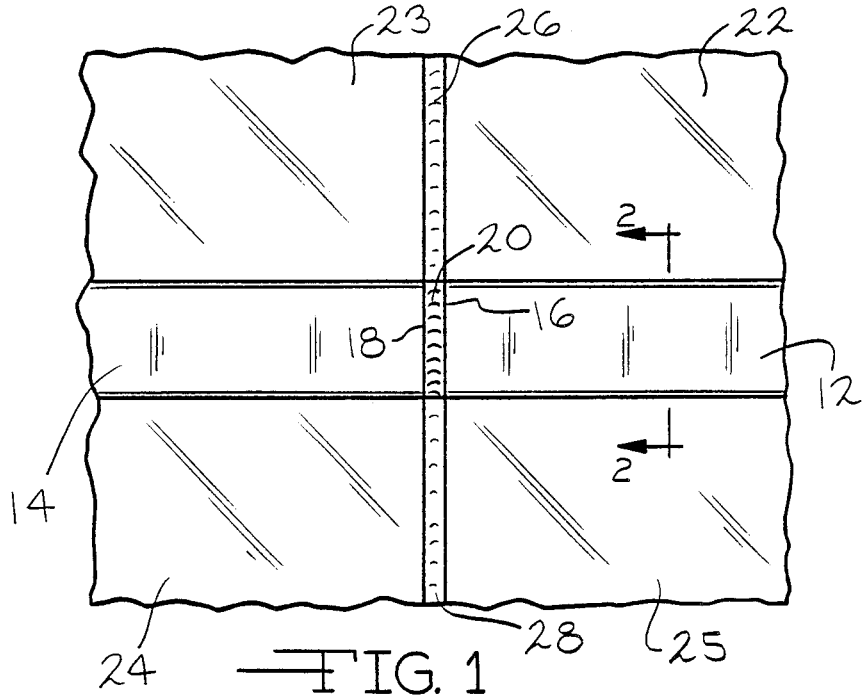
FIG. 1 is a front elevation view of a portion of a glass curtain wall.

A portion of a glass curtain wall is shown in FIG. 1. The curtain wall includes two end-to-end horizontal support members 12 and 14 having adjacent ends 16 and 18 which are separated by a space 20. The size of the space 20 between adjacent ends of the support members 12 and 14 is determined by the expansion and contraction of the support members due to temperature fluctuations. Support members 12 and 14 each define upwardly and downwardly directly U-shaped channels 35 and 43 respectively (FIG. 2) for retention of the glass panels 22, 23, 24, and 25 as shown in FIG. 1. The space 26 between panels 22 and 23 and the space 28 between panels 24 and 25 is filled with silicone sealant to prevent leakage.

Figure 2:
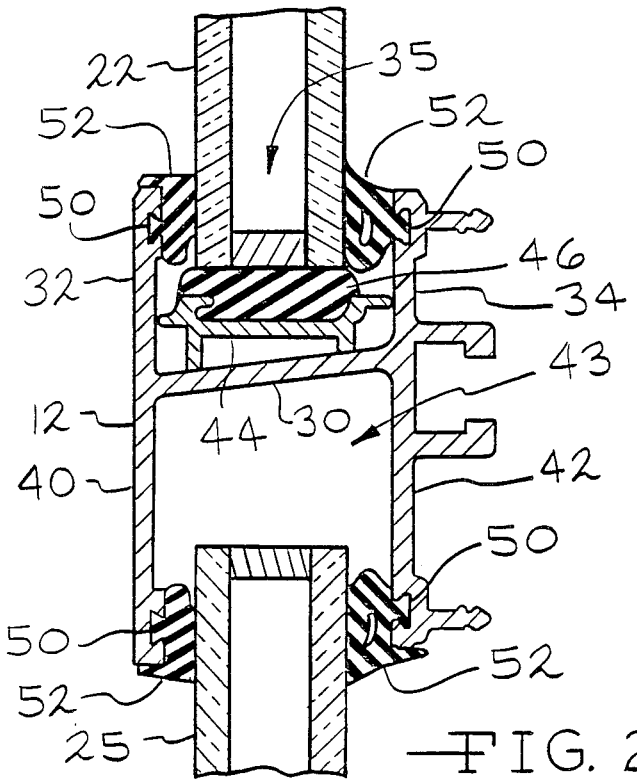
FIG. 2 is a sectional view as seen from substantially the line 2—2 of FIG. 1.

As illustrated in FIG. 2, the support member 12 includes a generally horizontal cross member 30. An outer vertical member 32 and an inner vertical member 34 extend upwardly from the cross member 30 defining the upper U-shaped channel 35. Likewise outer vertical member 40 and inner vertical member 42 extend downwardly from the cross member 30 to define the lower U-shaped channel 43.

A support frame 44 having a setting block 46 thereon is positioned within the upper channel for supporting the glass panel 22. The setting block 46 is made of silicone or rubber or like material.

Grooves 50 near the ends of vertical upper and downward members are used to mount gaskets 52 which seal against the inner and outer sides of the glass panels 22 and 25 to prevent leakage between the support member and the glass panels. The gaskets can be made of several suitable materials including silicone or rubber and are well known within the art.

Figure 3:
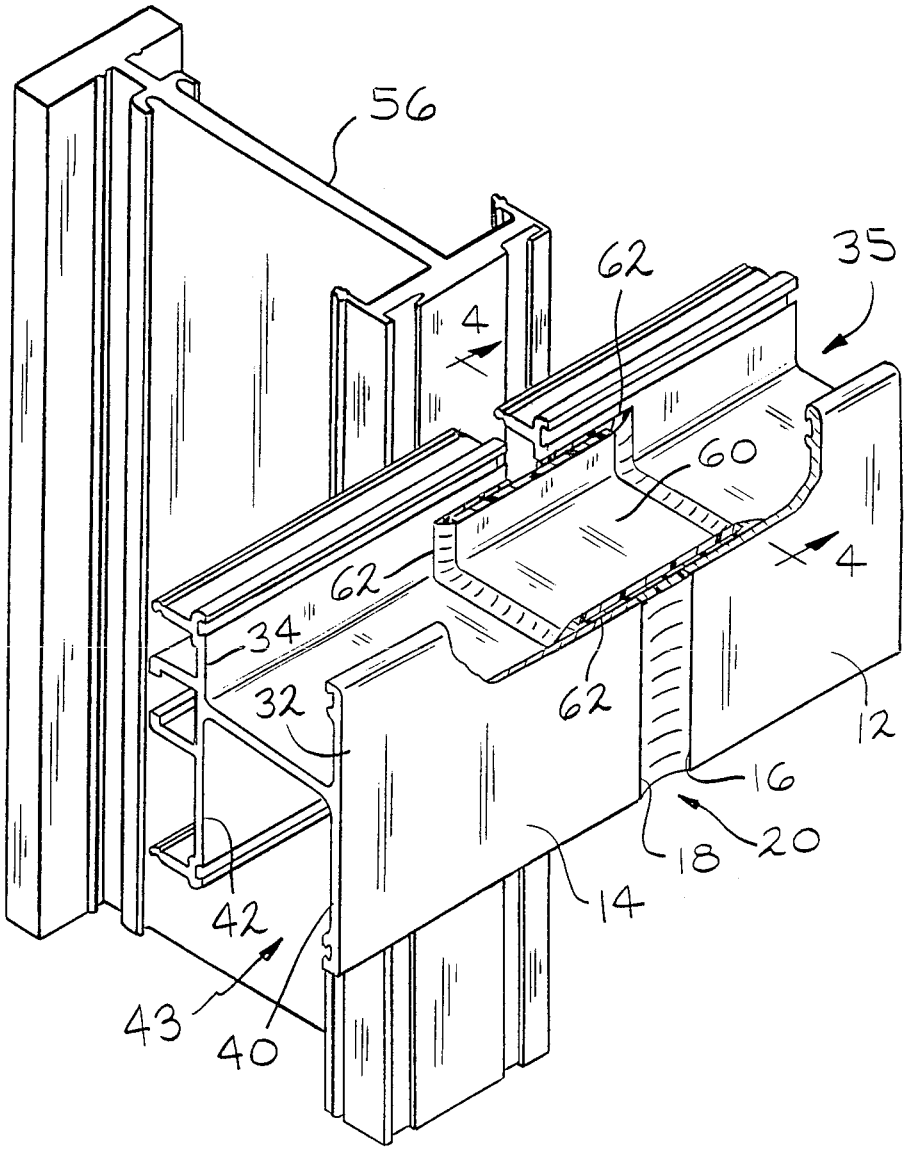
FIG. 3 is a perspective view showing a joint between adjacent horizontal support members showing the splice of this invention in position sealing the joint.

FIG. 3 is a perspective view showing the joint between the support members 12 and 14. A vertical mullion 56 is used to support the ends 16 and 18 of the support members. A molded silicone slab 60 is placed in the upper channel covering the cross member 30 and a portion of the two upward vertical members 32 and 34. The silicone slab 60 is held in place by a layer of locally applied flowable silicone sealant 62 between the slab 60 and the support members 12 and 14. In addition, the silicone sealant is placed within the space 20, shown at 64, between the outer vertical members 32 and 40.

The silicone slab 60 is made by molding silicone into a flat slab of the desired size which will bridge across the space 20 between support members 12 and 14. Suitable silicones include Dow Corning 796 silicone building sealant available from the Dow Corning Corporation; Gesil N 2600 sealant available from the General Electric Company; and spectrem 2 from Tremco. The silicone sealant 62 used to secure the slab 60 to the support members is a flowable material like a caulking material that is similar or identical to the silicone used to mold slab 60.

FIG. 4 is a cross section through support member 14 showing the silicone slab 60 and the sealer 62 in the upper channel. In addition, a second silicone slab 70 is positioned within the lower U-shaped channel on the inner surface of the downward vertical member 40. Silicone slab 70 is retained in place by a layer of silicone sealant 72. Slab 70, like slab 60, extends across the space 20 between the ends 16 and 18 of the support members.

FIG. 5 is a perspective view showing support members 56 and 58 which contain only a single U-shaped channel for supporting a curtain wall material. The support members 56 and 58 are for use at an edge of the curtain wall, for example at a bottom edge where the support member is mounted to a brick, concrete or other material having a flat surface 59. Support members 56 and 58 have adjacent end sections 64 and 66 respectively which are in a spaced relationship to one another defining a space 68 therebetween. The support members have a horizontal cross member 74, an outer vertical member 76 and an inner vertical member 78 which define a U-shaped channel 80 which is upwardly directed in this view. It is to be understood that the support members 56 and 58 can be orientated with the U-shaped channel directed upwardly, downwardly or in a sideways direction around any edge of a curtain wall.

The support members 56 and 58 are installed with a suitable backer rod 82 between the support member and the building surface 59, and are sealed with a silicone sealant 84 along the outer edge of the backer rod 82.

To prevent leakage between the support members 56 and 58, a molded silicone slab 90 is positioned within the U-shaped channel 80 and bridges the space 68 between the ends 64 and 66 of the support members. Silicone slab 90 is retained into place by a layer of silicone sealant 92 between the slab 90 and support members. A bead of silicone sealant 94 is placed in the space 68 along the exterior edge of the support members.

A sectional view through the support member 58 is shown in Figure 6 illustrating the silicone slab 90 and sealant 92.

The use of a silicone slab between adjacent ends of the support members in a curtain wall is an effective means of providing a leak proof joint between support members. The joint allows for movement of the support members relative to one another caused by expansion and contraction of the support members due to temperature fluctuation. The silicone slab is more effective in preventing leaks than caulking compound in that the silicone is more resistant to degradation caused by sun light, temperature cycles and the compression and tension exerted on the silicone as the joint expands and contracts.

It is to be understood that the invention is not limited to the exact construction or method illustrated and described above, but that various changes and modifications may be made without departing from the spirit and scope of the invention as defined in the following claims.

What is claimed is:

1. In a curtain wall structure having a plurality of wall panel members supported vertically in a frame structure wherein the frame structure includes:

a plurality of support members for said panels arranged in end-to-end relation with adjacent ends of adjacent members being spaced from one another; the improvement comprising:

at least one slab member formed of a flexible sealant material bridging the space between the adjacent ends of a pair of adjacent support members, and a flowable silicone caulking material adhering said slab to said adjacent ends of said adjacent members.

2. The structure of claim 1 wherein said support members are of generally U-shaped having a generally horizontal cross member and inner and outer upwardly directed vertical members, said silicone slab covering said horizontal cross member and at least a portion of said inner and outer vertical members adjacent each end of said support members.

3. The curtain wall of claim 2 further comprising a second U-shaped channel having inner and outer downwardly directed vertical sections from said horizontal cross member, a second silicone slab covering said downwardly directed outer member adjacent each end of said support members, said second silicone slab retained in said channel by a silicone sealant.

4. The curtain wall of claim 1 wherein said channel is generally U-shaped having a generally horizontal cross member and inner and outer downwardly directed vertical members, said silicone slab covering said outer vertical member adjacent each end of said support members.

* * * * *